United States Patent [19]

Berger et al.

[11] Patent Number: 4,978,067

[45] Date of Patent: Dec. 18, 1990

[54] UNITARY AXIAL FLOW TUBE ULTRASONIC ATOMIZER WITH ENHANCED SEALING

[75] Inventors: Harvey L. Berger, Hyde Park; Alan Paul, Kingston; William J. Broe, Stanfordville, all of N.Y.

[73] Assignee: Sono-Tek Corporation, Poughkeepsie, N.Y.

[21] Appl. No.: 455,252

[22] Filed: Dec. 22, 1989

[51] Int. Cl.[5] ..... B05B 3/14

[52] U.S. Cl. ..... 239/102.2; 310/325

[58] Field of Search ..... 239/102.2, 4; 261/DIG. 48; 310/325

[56] References Cited

U.S. PATENT DOCUMENTS 4,496,101 1/1985 Northman .

4,723,708 2/1988 Berger et al. ..... 234/102.2

OTHER PUBLICATIONS

"Ultrasonic Nozzles Atomize Without Air", *Machine Design*, Jul. 21, 1988, by Harvey L. Berger.

*Primary Examiner*—Andres Kashnikow

*Assistant Examiner*—Lesley Morris

*Attorney, Agent, or Firm*—Kenyon & Kenyon

[57] ABSTRACT

An axial flow tube ultrasonic atomizer in which the front horn section and axial flow section are of unitary construction. The device further comprises five sealing rings and two grooves cut into the unitary flow tube structure for receipt of the sealing rings. This structure results in better sealing and facilitates assembly.

3 Claims, 1 Drawing Sheet

UNITARY AXIAL FLOW TUBE ULTRASONIC ATOMIZER WITH ENHANCED SEALING

BACKGROUND OF THE INVENTION (1) Technical Field

The present invention represents an improvement in piezoelectric ultrasonic atomizers, particularly of the type having an atomizing surface at a tip of a reduced diameter amplifying probe at one end of a transducer and a coaxial fluid delivery channel extending from the other end of the transducer to the atomizing surface. Such a piezoelectric device was disclosed in the applicant's earlier patent no. U.S. Pat. No. 4,723,708 (Ser. No. 07/068,717) which is hereby incorporated by reference.

(2) Background Art

Piezoelectric ultrasonic atomizers are finding increasing use in industrial applications where liquid materials must be delivered in the form of a very fine spray or mist. The design and construction of such atomizers is described in U.S. Pat. No. 4,337,896 of BERGER et al. A typical arrangement is to sandwich a flat electrode between two disks of piezoelectric material, such as lead zirconate titanate, to form a driving element, and then to clamp the driving element between a cylindrical front amplifying horn and a cylindrical rear dummy section. The amplifying horn is provided with a reduced diameter probe having an atomizing surface at its tip. The amplification of vibrational amplitude obtained at the atomizing surface is approximately equal to the ratio between the respective cross-sectional areas of the cylindrical portion of the front horn and of the end of the probe.

In the type of atomizer shown in U.S. Pat. No. 4,337,896, the necessary clamping pressure on the driving element is obtained by providing circumferential flanges on the adjacent ends of the front and rear sections and sawing the flanges together with a circle of bolts. The flanges also provide an annular bearing area for compressing an elastomeric gasket ring, to prevent liquid spray from contacting the outer peripheries of the piezoelectric disks. The sealing effectiveness of such a gasket is an important factor in extending the operating life of the atomizer.

The electro-mechanical drive elements typically employed in an atomizer are vulnerable to the corrosive effect of the fluid being atomized. Improper sealing against the environment is a problem in the art. Typically, sealing rings have been employed to effect a seal. The U.S. Pat. No. 4,496,101 to NORTHMAN, for example, discloses the use of sealing rings in the front portion of the housing (66 in FIG. 1), but fails to disclose the use of cooperating groove structure therewith (such as the reference shows for the rear portion).

SUMMARY OF THE INVENTION

It is an object of the present invention to provide a piezoelectric atomizer design having a maximum practical amplification.

It is another object of the present invention to effect such a design utilizing more compact structure and a minimum of parts.

It is another object of the present invention to provide an axial feed piezoelectric atomizer that provides effective internal sealing without compromising the performance of the piezoelectric elements.

Another object of the invention is to provide external sealing of the piezoelectric elements in an atomizer as characterized above without axially loading the transducer element.

The above and other objects are achieved in an ultrasonic liquid atomizing transducer assembly comprising:

a driving element including a pair of annular piezoelectric disks and an electrode coaxially positioned therebetween;

terminal means for feeding ultrasonic frequency electrical energy to said electrode;

a cylindrical rear dummy section having a front end adjacent one piezoelectric disk of the driving element, and a rear end;

a unitary axial section comprising from front to rear, a conical amplifying front horn section of quarter-wavelength length, said amplifying section extending from the front face of a widened disk shaped front section into which has been cut an annular groove to accommodate a sealing ring, said front section having front and rear surfaces, the latter of which abuts the other piezoelectric disks of the driving element; an elongated tubular axial section about which are placed the piezoelectric crystals and to which is threadably mounted the rear dummy section, said axial section further comprising a feed-through bore for the passage of fluid;

To prevent the liquid contact with the outer surfaces of the piezoelectric disks, the assembly may further comprise an enclosed shell surrounding the transducer assembly, the shell having a front end wall provided with an opening that slidably receives the disk-shaped portion of the front section and a radially compressed annular sealing means disposed in an annular groove cut into said front disk sections. The shell further has a rear wall that may be provided with an opening that slidably receives an axial feed tube extending from the rear end of the rear dummy section and a radially compressed annular sealing means disposed between the opening and the feed tube which resides in a groove milled into the feed tube.

The above and other objects, features and advantages of the present invention will be more readily apparent from the following description of the preferred embodiments when considered With the accompanying drawings and the appended claims.

BRIEF DESCRIPTION OF THE DRAWINGS

The present invention is illustrated by way of example and not limitation in the figures of the accompanying drawing in which like numerals indicate the same or similar parts and in which.

DESCRIPTION OF THE PREFERRED EMBODIMENT

Figure 1:
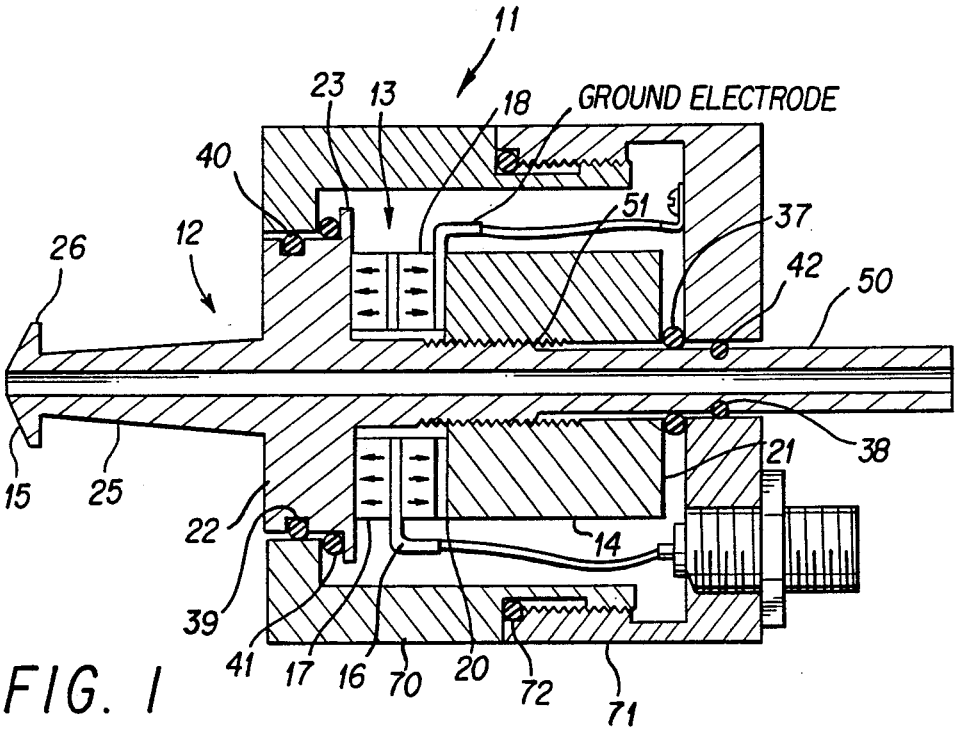
FIG. 1 is a partially cut away perspective view of an ultrasonic atomizing transducer assembly according to the invention.
Figure 2:
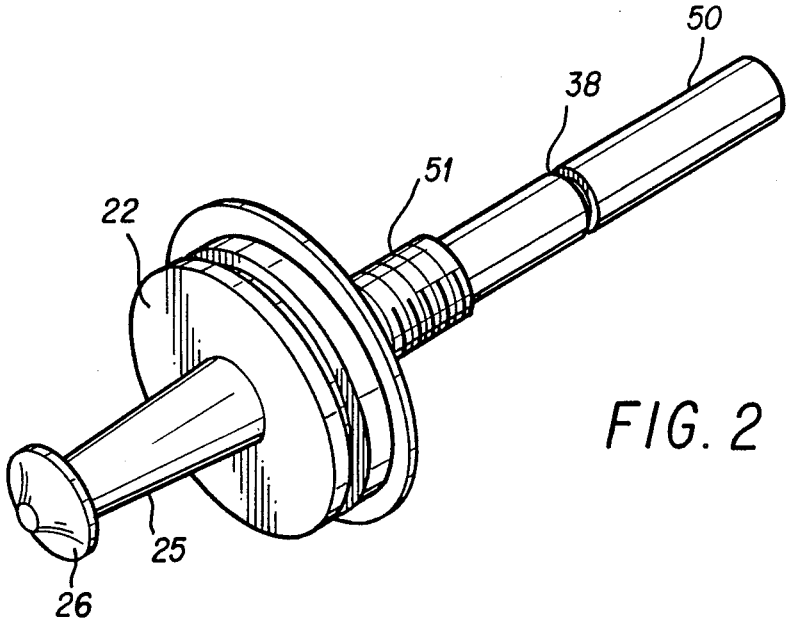
FIG. 2 is a view in perspective of the unitary front horn and axial flow tube.

With reference to the figures, a currently preferred embodiment of an ultrasonic atomizing transducer assembly 11 includes a transducer 12 having a driving element 13, a rear dummy section 14, and a front atomizing surface 15.

The driving element 13 is assembled from an input electrode 16 sandwiched between a pair of annular piezoelectric disks 17 and 18. The electrode may be made of copper or any other suitable metal having high electrical conductivity, and it is provided with a terminal for attachment to a source of electrical energy at the resonant frequency of the transducer. The piezoelectric disks are made of any material conventionally used for such service, such as barium titanate or lead zirconate titanate.

The rear dummy section 14 is a metal cylinder, preferably titanium, having a length (when taken in combination with disk 18) equal to a quarter wavelength at the designed operating frequency of the transducer. A front end 20 of the rear section 14 contacts the rear piezoelectric disk 18, and a rear end 21 of the rear section is free to vibrate as an antinodal plane. The front atomizing section 15 is connected to a quarter wavelength amplifying probe 25 which extends to a terminal portion 26. Probe 25 is unitary with front disk section 22 which contains an annular groove 39 into which is placed a sealing ring 40.

The front atomizing section preferably is made of the same material as the rear dummy section, although a different material could be used if desired, so long as the appropriate wavelength dimensions were used to match the operating frequency of the rear section.

The dummy section is clamped against the driving element 13 with a predetermined compressive stress by advancing it an appropriate distance along threads 51 cut onto feed tube 50.

An important object of this invention is simplification of design and the concommitant extension of useful life. To this former end the front horn 25 and feed tube are of unitary construction in quarter wavelength design. To the latter end, enhanced sealing elements have been provided to prevent the transducer from coming into contact with the external environment.

A two piece outer shell (70, 71) is threaded together about the transducer in a cup-like configuration. Front housing 70 and rear housing 71 are further sealed by the use of a sealing ring 72. The front section 70 is configured to press against the sealing ring 40 of groove 39. Such a use of a front groove sealing structure greatly enhances the sealing attained. The front section achieves a second seal against flange 23 of disk 22 by use of a second ring 41. However, the primary function of sealing ring 41 is to act as a front bumper, holding in place the internal structure of the device. The rear face of shell 71 is sealed against axial feed tube 50 by use of sealing ring 42 disposed in a groove 38 cut into the axial tube. As with the front section, a second seal is provided here. Sealing ring 37 provides a further seal between the rear wall of dummy cylinder 14 and the inner wall of the rear section. As with ring 41, ring 37 acts primarily to hold in place the device internal structure by serving as a rear bumper.

Hence are provide five separate sealing rings, two of which are disposed in grooves, for better protecting the transducer from environmental attacks.

Accordingly, the design of the present invention is adapted to provide an ultrasonic atomizing transducer that is simple to manufacture and is completely shielded from damp or hazardous environments, such as explosive atmospheres.

What is claimed is:

1. An ultrasonic liquid atomizing transducer assembly with enhanced sealing against external fluids comprising:

a driving element including a pair of annular piezoelectric disks and an input electrode;

means for feeding ultrasonic frequency electrical energy thereto;

a cylindrical rear dummy section having a front end contacting one piezoelectric disk of the driving element, a rear end, a threaded bore, and a constant outside diameter from the front end to the rear end;

a unitary axial feed tube and atomizing surface, comprising from front to rear:

(a) an atomizing tip;

(b) a conical quarter wavelength amplifying probe or horn extending to:

(c) a disk section with front, rear, and circumferential surfaces, said rear surface comprising a circumferential flange sized for the retention of a sealing ring, and said circumferential surface of said disk having a groove cut thereinto to act as a receptacle for a sealing ring;

(d) an axial flow tube of reduced diameter which bears threads on its outer mid-section for the threadable attachment of the dummy section thereto, and which bears at its rear end a groove cut thereon to receive a sealing ring.

2. An ultrasonic liquid atomizing transducer assembly with enhanced sealing against external fluids comprising:

a driving element including a pair of annular piezoelectric disks and an input electrode;

means for feeding ultrasonic frequency electrical energy thereto;

a cylindrical rear dummy section having a front end contacting one piezoelectric disk of the driving element, a rear end, a threaded bore, and a constant outside diameter from the front end to the rear end;

a unitary axial feed tube and atomizing surface, comprising from front to rear;

(a) an atomizing tip;

(b) a conical quarter wavelength amplifying probe or horn extending to:

(c) a disk section with front, rear, and circumferential surfaces, said rear surface comprising a circumferential flange sized for the retention of a sealing ring, and said circumferential surface of said disk having a groove cut thereinto to act as a receptacle for a sealing ring;

(d) an axial flow tube of reduced diameter which bears threads on its outer mid-section for the threadable attachment of the dummy section thereto, and which bears at its rear end a groove cut thereon to receive a sealing ring;

(e) an axial through-bore for the passage of fluid;

two piece cup-shaped housing elements threadably attached to each other so as to define a gap therebetween for the placement of a sealing ring, a sealing ring within said gap, front and rear end faces which contain holes sized to mate with the front disk and reduced diameter axial flow tube portion respectively, sealing rings placed along the outer portion of the front disk against the flange there situated and within the circumferential groove of the front disk which mate against the front face of the front housing element, sealing rings placed immediately adjacent the rear wall of the dummy section and within the groove along the axial flow tube to mate with the face of the rear housing element and act as rear and front bumpers to maintain the transducer structure in place inside the cups.

3. The device of claim 2 wherein the transducer is of quarter wavelength design.

* * * * *